United States Patent [19]

Yoshinaga et al.

[11] Patent Number: 4,470,392

[45] Date of Patent: Sep. 11, 1984

[54] MULTI-GAP SPARK IGNITION DEVICE FOR ENGINE

[75] Inventors: Toru Yoshinaga, Okazaki; Toshihiko Igashira, Toyokawa; Hisasi Kawai, Toyohashi; Seiji Morino, Okazaki; Norihiko Nakamura, Mishima, all of Japan

[73] Assignees: Nippon Soken, Inc., Nishio; Toyota Jidosha Kabushiki Kaisha, Toyota, both of Japan

[21] Appl. No.: 482,707

[22] Filed: Apr. 6, 1983

[30] Foreign Application Priority Data

Apr. 7, 1982 [JP] Japan ..... 57-57801
Apr. 16, 1982 [JP] Japan ..... 57-64362

[51] Int. Cl.[3] ..... F02P 15/02; F02M 25/06

[52] U.S. Cl. ..... 123/310; 123/608; 123/636; 123/637; 123/638

[58] Field of Search ..... 123/310, 608, 636, 638, 123/640, 605, 647, 627, 637

[56] References Cited

U.S. PATENT DOCUMENTS

| | | | |
|---|---|---|---|
| 1,316,560 | 9/1919 | Conrad | 123/627 |
| 1,461,300 | 7/1923 | Winchester et al. | 123/310 |
| 1,956,332 | 4/1934 | Nudl | 123/627 |
| 3,035,108 | 5/1952 | Kaehni | 123/637 |
| 3,081,360 | 3/1963 | Kaebni | 123/637 |
| 3,280,809 | 10/1966 | Issler | 123/637 |
| 4,217,873 | 8/1980 | Nishio et al. | 123/605 |

FOREIGN PATENT DOCUMENTS 2811049 9/1978 Fed. Rep. of Germany ..... 123/636

OTHER PUBLICATIONS

"Air Information Circular" vol. V, Feb. 15, 1923, No. 401 by R. Insley-published by Chief of Air Service, Wash. D.C.

*Primary Examiner*—Raymond A. Nelli
*Attorney, Agent, or Firm*—Cushman, Darby & Cushman

[57] ABSTRACT

A multi-gap spark ignition device to be installed in a spark ignition engine, is disclosed. The device comprises a metallic base member provided with a hole which forms one portion of the combustion chamber of the engine. Within the wall defining the hole, a high voltage electrode, a plurality of intermediate electrodes and an earth electrode are embedded at regular intervals so that each end of the electrodes project into the hole to form a plurality of spark gaps between the adjacent ends of the electrodes. Each of the intermediate electrodes is composed of an electrode member and an insulating member for covering one end of the electrode member, and is closely inserted into a groove formed in one end surface of the base member along the hole thereof at regular intervals. By making the stray electrostatic capacity between the base member and the opposed electrode member of each intermediate electrode larger than the electrostatic capacity between the adjacent electrode members, the required voltage can be maintained small irrespective of the number of the intermediate electrodes.

9 Claims, 8 Drawing Figures

MULTI-GAP SPARK IGNITION DEVICE FOR ENGINE

BACKGROUND OF THE INVENTION

The present invention relates to a multi-gap spark ignition device to be installed in a spark-ignition engine.

Recently, lean-burn system, exhaust gas recirculation system or the like has been adopted in order to reduce harmful components in the exhaust gases of an automobile and in order to prevent the waste of resources. In these systems, excellent ignitability and high combustion speed are required.

The ignitability and the combustion speed can be improved by increasing the number of igniters so as to promote the flame transmission within a combustion chamber. However, in this case, the number of igniters and distributers must be increased.

In order to reduce the number of the igniters and the distributers, such a system that a plurality of spark gaps are formed in series, has been proposed.

FIGS. 1, 2 illustrate a conventional multi-gap spark ignition device, respectively.

A base member 4 formed of an electrically insulating ceramic plate, is mounted between a cylinder head 5 and a cylinder block 6 of an internal combustion engine of an automobile while sandwiching a gasket 7 between the base member 4 and the cylinder head 5, and between the base member 4 and the cylinder block 6, respectively.

A hole 40 is formed in the base member 4 so as to form one portion of the combustion chamber 8.

A high voltage electrode 1, an earth electrode 2, and a plurality of intermediate electrodes 3A, 3B, 3C, 3D and 3E which are arranged at regular intervals between the high voltage electrode 1 and the contact electrode 2, are embedded within the opposed walls of the base member 4 defining the hole 40 as to project into the hole 40. And a plurality of spark gaps are formed between the adjacent electrodes in series.

However, the ceramic base member 4 is liable to be broken while being assembled or due to thermal strain occuring when the internal combustion engine operates.

In another conventional multi-spark gap ignition device, a plurality of plugs each of which is formed by covering the high voltage electrodes and the intermediate electrode with the electrically insulating material, are screwed into the wall defining the combustion chamber, by means of bolts so as to penetrate therethrough.

However, in this device, excellent workability cannot be obtained.

Particularly, in the multi-cylinder type engine, a large number of plugs for adjacent cylinders must be fixed to the same wall portion of the base member so that the interference between adjacent electrodes is liable to occur.

On the other hand, a multi-gap spark ignition device wherein a plurality of spark gaps are formed in series also has a problem that as the number of spark gaps increase, the required voltage increases so that the electric power consumption increases.

One object of the present invention is to provide a multi-gap spark ignition device for an engine, having a simple construction, wherein a plurality of electrodes are easily mounted on a base member.

Another object of the present invention is to provide a durable multi-gap spark ignition device of which the base member is not broken.

Still another object of the present invention is to provide a multi-gap spark ignition device of which the required voltage for generating spark in each gap is low as compared with the conventional ignition device.

SUMMARY OF THE INVENTION

The multi-gap spark ignition device of the present invention comprises a metallic plate provided with a hole which forms one portion of the combustion chamber. Within the wall defining the hole, a high voltage electrode, a plurality of intermediate electrodes and an earth electrode are embedded at regular intervals. Each end of the electrodes project into the hole to form a plurality of spark gaps between the adjacent ends of the electrodes.

Each of the intermediate electrodes is composed of an electrode member and an insulating member for covering one end of the electrode member, and is closely inserted into a groove formed in one end surface of the base member along the hole thereof at regular intervals.

The base member wherein the high voltage electrode, the intermediate electrodes and the earth electrode are embedded, is interposed between a cylinder head and a cylinder block and fixed thereto through a gasket, respectively.

In the multi-gap spark ignition device having the above described construction, the required voltage can be maintained small irrespective of the number of the intermediate electrodes by making the stray electrostatic capacity between the electrode member of each intermediate electrode and the base member which is opposed to the electrode member through the insulating member larger than, preferably by four or more times the electrostatic capacity between the adjacent electrode members which are opposed to each other through a spark gap.

DESCRIPTION OF THE EMBODIMENTS

Hereinafter, the present invention will be explained in accordance with the embodiment thereof with reference to the drawings.

Figure 1:
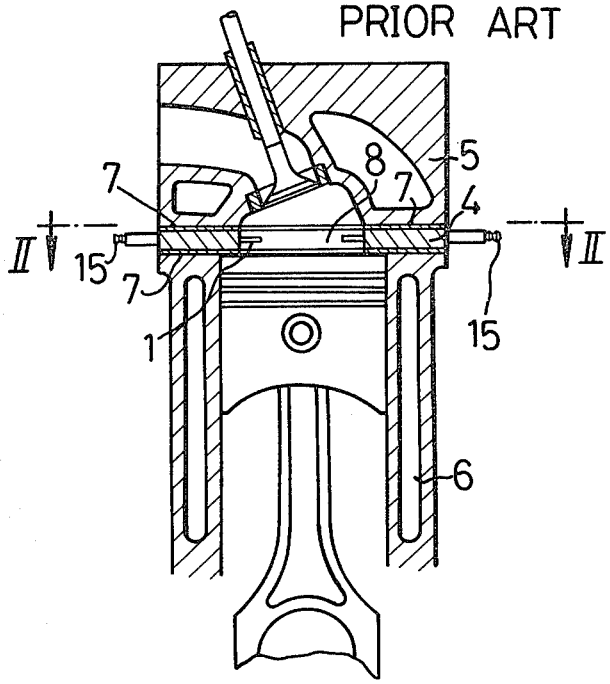
FIG.1 PRIOR ART
FIG. 1 is a longitudinal sectional view of an engine provided with a conventional multi-gap spark ignition device.
Figure 2:
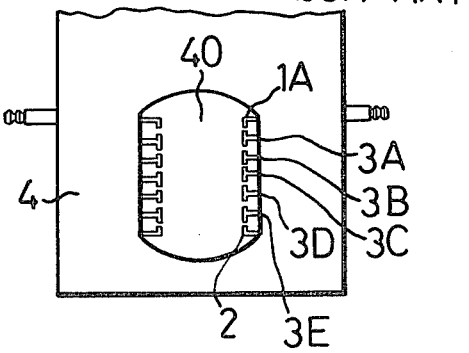
FIG.2 PRIOR ART
FIG. 2 is a sectional view taken along the line II—II of FIG. 1.

In the embodiment, a metallic base member 4 is mounted between a cylinder head 5 and a cylinder block 6 through a gasket, respectively and the metallic base member 4 is provided with a hole 40 which forms one portion of the wall defining a combustion chamber 8 similar to the conventional ignition device shown in FIG. 1.

Figure 3:
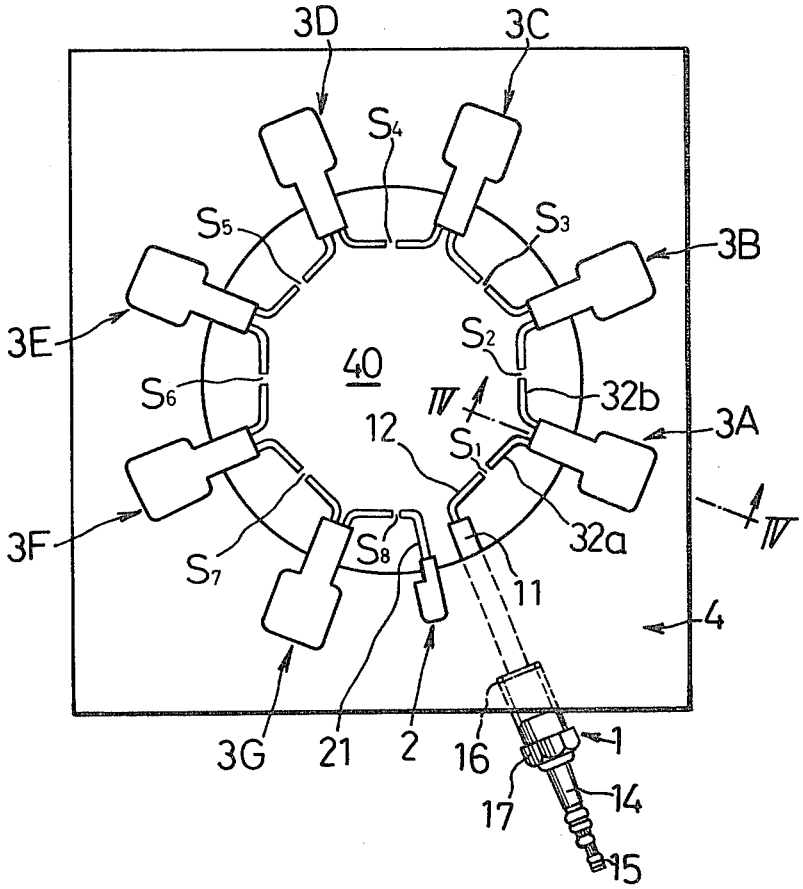
FIG. 3 is a plan view of a multi-gap ignition device of the present invention.

A high voltage electrode 1, an earth electrode 2, intermediate electrodes 3A, 3B, 3C, 3D, 3E, 3F, 3G are disposed around the hole 40 at regular intervals as shown in FIG. 3.

The high voltage electrode 1 is of a plug type and comprises an insulator 11 made of alumina porcelain, an electrode member 12 made of a nickel alloy wire having a diameter of about 1 mm, an electrode rod 14 and a high voltage terminal 15.

The high voltage electrode 1 having the above described construction is inserted into an open hole provided within the metallic base member 4 from the outside thereof and integrally fixed to the metallic base member 4 by means of a knut 17.

The electrode member 12 projects from the top end of the insulator 11 into the hole 40 and the top end of the electrode member 12 is bent after the high voltage electrode 1 is inserted into the metallic base member 4.

The reference numeral 16 designates a copper washer.

The earth electrode 2 is closely inserted into a groove formed in the metallic base member 4 so as to be adjacent to the high voltage electrode 1 and then fixed to the metallic base member 4 by welding.

An electrode member 21 of the earth electrode 2 is bent in the opposite direction to the bending direction of the electrode member 12 of the high voltage electrode 1.

The intermediate electrodes 3A to 3G, each of which has the same construction as one another, are disposed around the hole 40 of the metallic base member 4 at regular intervals.

Hereinafter, the intermediate electrodes 3A will be explained in detail.

Figure 4:
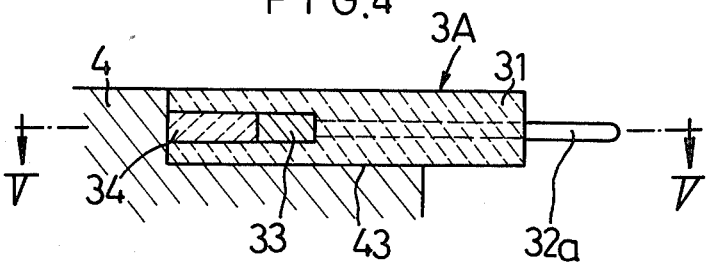
FIG. 4 is a sectional view taken along the line IV—IV of FIG. 3.
Figure 5:
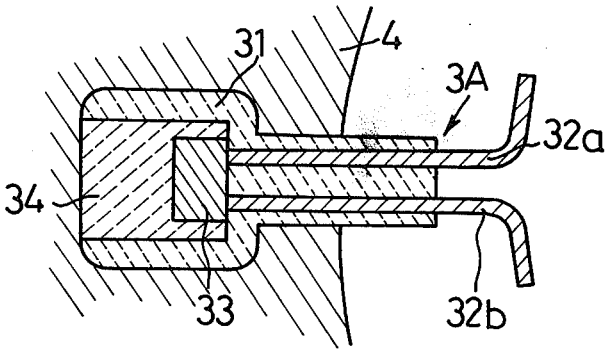
FIG. 5 is a sectional view taken along the line V—V of FIG. 4.

As shown in FIGS. 4, 5, the intermediate electrode 3A comprises an insulator 31, a pair of electrode members 32*a*, 32*b*, having a diameter of about 1 mm, which is made of nickel alloy, an electrode supporting plate 33 made of copper, and an insulating seal member 34. The insulator 31 is formed into a plate-shape of which the thickness is 5 to 6 mm and the width of the base portion of the insulator 31 is made larger than that of the top end portion thereof.

The top end of each of the electrode members 32*a*, 32*b* is bent in the direction of the adjacent electrode while the base end of each of the electrode members 32*a*, 32*b* is fixed to the supporting plate 33 by soldering.

The supporting plate 33 is disposed within the base portion of the insulator 31 and sealed by means of the insulating seal member 34.

In the upper surface of the metallic base member 4, six grooves 43 having the plane shape corresponding to that of the insulator 31 and the depth equal to the thickness of the insulator 31, are formed along the hole 40.

The intermediate electrode 3A having the above described construction is closely inserted into one of the grooves 43 so that the bent top end portion of each of the electrode members 32*a*, 32*b* project into the hole 40.

The other intermediate electrodes 3B to 3G have the same construction as that of the intermediate electrode 3A, respectively.

Between the adjacent electrode members, spark gaps $S_1$, $S_2$, $S_3$, $S_4$, $S_5$, $S_6$, $S_7$, $S_8$ are formed. These spark gaps are electrically connected in series.

The metallic base member 4 on which the electrodes are mounted, is interposed between the cylinder head 5 and the cylinder block 6 of the internal combustion engine and is fixed thereto a gasket, respectively.

In operation, when a high voltage is applied to the terminal 15 of the high voltage electrode 1 from an ignition coil (not shown), the breakdown successively occurs in the spark gaps $S_1$ to $S_8$ in this order so that spark discharge occurs therein.

According to the multi-gap spark ignition device of the present invention, since the metallic plate is used as the base member on which the electrodes are mounted, cracks are not formed therein. Since each of the intermediate electrodes is thin and small, a large number of intermediate electrodes can be mounted within a limited space, as compared with the conventional device wherein the electrodes are screwed into the base member from the outside thereof.

Furthermore, since the flat plate-shaped intermediate electrodes are mounted on the metallic base member so as to form the same upper surface as that of the metallic base member, the metallic base member can be airtightly fixed between the cylinder head and the cylinder block so that the excellent air tight condition of the combustion chamber can be maintained.

In addition, the intermediate electrodes can be easily mounted on the metallic base member by merely fitting them into the grooves formed in the metallic base member.

The intermediate electrodes can be formed into another shape such as a trapezoidal plane shape, trapezoidal, triangular, semi-circular cross sectional shape, etc.

Furthermore, the cylinder head or the cylinder block can be used as the base member. In this case, in the opposed surface of the cylinder head or the cylinder block, a plurality of grooves for accommodating the intermediate electrodes are formed.

In addition, the high voltage electrode can be mounted on the metallic base member by fitting the high voltage electrode into a groove formed in the upper surface of the metallic base member similar to the intermediate electrodes.

The inventors have studied to lower the voltage required by the multi-gap spark ignition device wherein a plurality of spark gaps are arranged in series.

The required voltage theoretically increases in proportion to the number of the the spark gaps. However, as a result of the inventor's experiment, the required voltage increased by one and a half times and two and a half times as the spark gaps increased by two times and three times.

The inventors have considered that the above experimental result is caused by the fact that stray electrostatic capacity occurs between the electrode supporting plate 33 of each intermediate electrode and the metallic base member 4 which is opposed to the supporting plate 33 through the insulator 31 and the seal member 34.

Figure 6A:
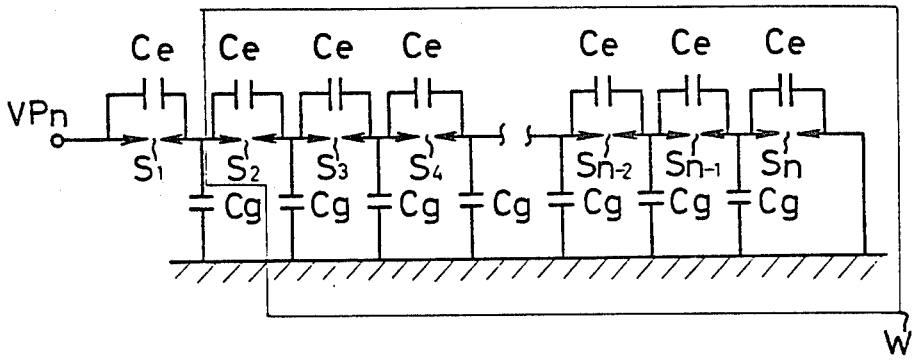
FIG. 6 is a view illustrating an electrically equivalent circuit of a multi-gap spark ignition device of the present invention.
Figure 6:
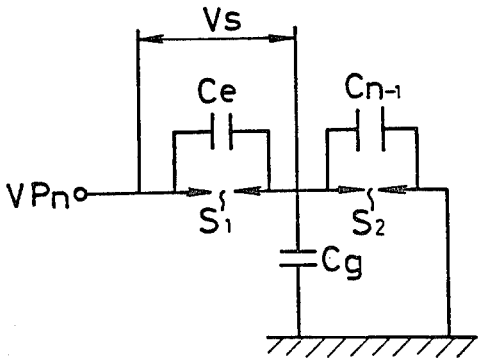

FIGS. 6(*a*), 6(*b*) show the electrically equivalent circuits wherein the $(n-1)$ intermediate electrodes are provided to form spark gaps $S_1$ to $S_n$.

The reference character Vpn designates an applied voltage which is required when n spark gaps are formed, Ce designates the electrostatic capacity of each of the spark gaps $S_1$, $S_2$ - - - Sn and Cg designates the electrostatic capacity occurring between the supporting plate 33 of the intermediate electrode 3 and the base member 4.

The reference character $C_{n-1}$ shown in FIG. 6(*b*) designates the electrostatic capacity equivalent to that of the condensor circuit encircled by the line W in FIG. 6(*a*).

In FIG. 6(*b*), the applied voltage Vpn required when n spark gaps are formed in expressed by the equation (1)

$$Vpn = \frac{Ce + (Cn - 1 + Cg)}{Cn - 1 + Cg} Vs \quad (1)$$

The ratio (Rn) of the applied voltage (Vpn) to the discharge voltage (Vs) is expressed by the equation (2)

$$Rn = \frac{1 + \frac{Cn-1}{Ce} + \frac{Cg}{Ce}}{\frac{Cn-1}{Ce} + \frac{Cg}{Ce}} = \frac{1 + \frac{Cn-1}{Ce} + x}{\frac{Cn-1}{Ce} + x} \quad (2)$$

As the ratio X(Cg/Ce) of the second electrostatic capacity Cg to the first electrostatic capacity Ce varies from 0 to infinity, the ratio Rn varies from 1 to n.

Figure 7:
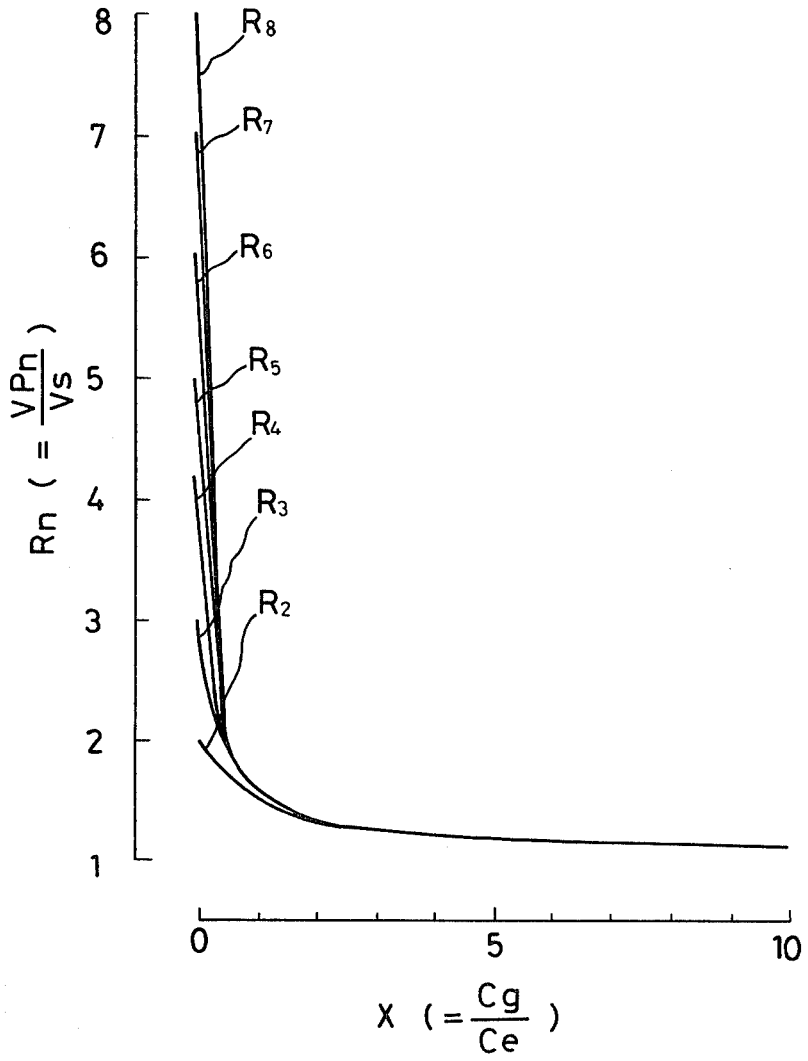
FIG. 7 is a view showing the theoretical relation between the required voltage and the electrostatic capacity of the multi-gap spark ignition device.

FIG. 7 shows the relation between the ratio X and the ratio Rn, wherein n is from 1 to 8.

When the ratio X is above 4, the ratio Rn is near 1 irrespective of the value of n.

Namely, by increasing the second electrostatic capacity Cg by 4 or more times the first electrostatic capacity Ce, the applied voltage Vpn can be decreased to the value nearly equal to the discharge voltage Vs even in the multi-gap spark ignition device.

Figure 8:
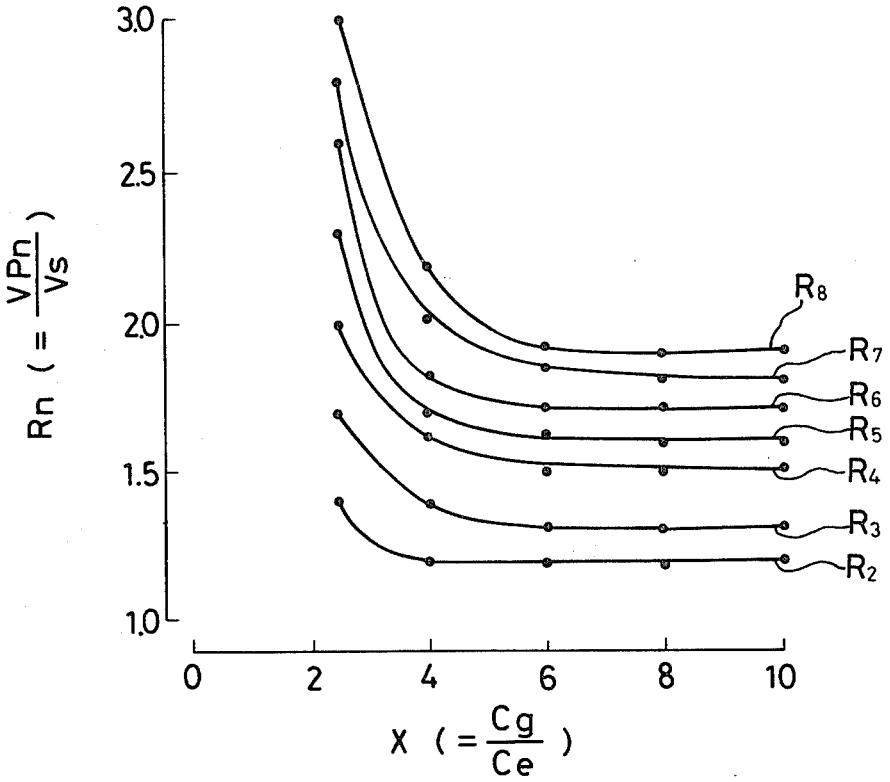
FIG. 8 is a view showing the experimental result on the relation between the required voltage and the electrostatic capacity of the multi-gap spark ignition device of the present invention.

The above theoretical value was experimentally confirmed. The experimental result was shown in FIG. 8.

Since the energy was practically lost in each spark gap at the discharging time, the ratio Rn was larger than its theoretical value as the number of the spark gaps increased.

However, even when eight gaps are formed, the ratio $R_8$ can be decreased to about 2 by making the ratio X of the electrostatic capacity Cg to the electrostatic capacity Ce to above 4. Namely, in this case, the applied voltage $Vp_8$ about two times as large as the discharge voltage Vs is only required.

As described above, according to the present invention, by increasing the stray electrostatic capacity between the intermediate electrode and the base member by four or more times the electrostatic capacity between the adjacent electrode members, the ignition coil need not generate a high voltage.

Therefore, the ignition coil can be made small and the wiring parts of high performance is not required so that the production cost of the ignition device can be reduced.

Furthermore, heat radiation from each of the intermediate electrodes is promoted by the electrode supporting plate provided therein so that pre-ignition can be prevented.

The electrostatic capacity between the adjacent electrode members is preferably not more than 15 pF in consideration of the electricity supplying capacity of the ignition coil of practical use.

The stray electrostatic capacity between the electrode supporting plate of the intermediate electrode and the metallic base member can be varied by varying the area of the surface of the electrode supporting plate, which is opposed to the metallic base member.

Furthermore, according to the present invention, ignitability and combustion speed of the air-fuel mixture in the combustion chamber of an engine can be improved.

And the ignition device of the present invention is excellent in durability and can be easily mounted on the engine.

In addition, a large number of electrodes can be mounted in the limited space of the base member.

According to the present invention, by setting the stray electrostatic capacity between each intermediate electrode and the metallic base member four or more times as large as the electrostatic capacity between adjacent two electrode members, the voltage required for the ignition device can be decreased as compared with the conventional ignition device.

What is claimed is:

1. A multi-gap spark ignition device for an engine, provided with a plurality of spark gaps formed in series, comprising:

a metallic base member for forming one portion of a combustion chamber of said engine:

a high voltage electrode which is insulatedly fixed to said base member;

said high voltage electrode being provided with an electrode member projecting into said combustion chamber;

an earth electrode which is fixed to said base member so as to project into said combustion chamber; and a plurality of intermediate electrodes which are insulatedly fixed to said base member;

each of said intermediate electrodes being provided with an electrode member projecting into said combustion chamber to form a plurality of spark gaps in series between said opposed electrode members of said high voltage electrode and said intermediate members and between said earth electrode and the opposed electrode member of said intermediate electrode, and an electrically insulating member for covering the base portion of said electrode member;

said base member being provided with a plurality of grooves along the wall defining said combustion chamber which are formed between said high voltage electrode and said earth electrode so as to open into said combustion chamber;

said intermediate electrodes being fit into said grooves.

2. A multi-gap spark ignition device according to claim 1, wherein:

said insulating member has a plate shape; and said groove has a shape and size corresponding to said insulating member.

3. A multi-gap spark ignition device according to claim 2, wherein:

said base member is metallic plate which is interposed between the contact surfaces of said cylinder block and said cylinder head of said engine;

said base member is provided with an open hole of which the size and shape correspond to those of said combustion chamber;

said high voltage electrode, said intermediate electrodes and said earth electrode are provided along said open hole at regular intervals;

said grooves are formed in one surface of said base member along said open hole; and said intermediate electrodes are fit into said groove and strongly sandwiched between said base member and said cylinder block or said cylinder head.

4. A multi-gap spark ignition device according to claim 2, wherein:

said base member is a cylinder block or a cylinder head of said engine;

said grooves are formed in the contact surface of said cylinder block or said cylinder heat at regular intervals; and said high voltage electrode, said intermediate electrodes and said earth electrode are provided along said combustion chamber at regular intervals.

5. A multi-gap spark ignition device according to claim 2, wherein:

said grooves are radially formed along the wall defining said combustion chamber; and said high voltage electrode and said earth electrode are provided so as to be adjacent to each other at a small distance.

6. A multi-gap spark ignition device according to claim 2, wherein:

said electrode member of each of said intermediate electrode is composed of one pair of wires of which the base ends are connected to each other; and said wires extend in parallel while the top ends thereof are bent in opposite directions.

7. A multi-gap spark ignition device according to claim 6, wherein:

said base end of said wires are connected by means of a metallic plate which is disposed within said insulating member.

8. A multi-gap spark ignition device according to claim 7, wherein:

the stray electrostatic capacity between said metallic plate and the opposed base member is set four or more times as large as the the electrostatic capacity between adjacent electrode members which are opposed to each other through a spark gap.

9. A multi-gap spark ignition device according to claim 8, wherein:

the electrostatic capacity between adjacent electrode members which are opposed to each other through a spark gap is not more than 15 pF.

* * * * *